US005581325A

United States Patent [19]

Tsuda et al.

[11] Patent Number: 5,581,325

[45] Date of Patent: Dec. 3, 1996

[54] PROCESS CARTRIDGE HAVING AN ELECTROCONDUCTIVE GROUNDING MEMBER AND AN IMAGE FORMING APPARATUS USING SUCH A PROCESS CARTRIDGE

[75] Inventors: Tadayuki Tsuda, Hachioji; Shinichi Sasaki, Fujisawa; Isao Ikemoto, Kawasaki, all of Japan

[73] Assignee: Canon Kabushiki Kaisha, Tokyo, Japan

[21] Appl. No.: 314,299

[22] Filed: Sep. 30, 1994

[30] Foreign Application Priority Data

Oct. 1, 1993 [JP] Japan ..... 5-246710
Sep. 16, 1994 [JP] Japan ..... 6-221516

[51] Int. Cl.[6] ..... G03G 15/00; G03G 21/00

[52] U.S. Cl. ..... 355/200; 355/211

[58] Field of Search ..... 355/200, 210, 355/211, 212

[56] References Cited

U.S. PATENT DOCUMENTS

| | | | |
|---|---|---|---|
| 3,743,410 | 7/1973 | Edelman et al. | 355/212 X |
| 4,839,690 | 6/1989 | Onoda et al. | 355/211 |
| 4,975,744 | 12/1990 | Ebata et al. | 355/211 |
| 5,210,574 | 5/1993 | Kita | 355/211 |
| 5,331,372 | 7/1994 | Tsuda et al. | 355/200 |
| 5,345,294 | 9/1994 | Nomura et al. | 355/200 |
| 5,357,321 | 10/1994 | Stenzel et al. | 355/211 |
| 5,394,224 | 2/1995 | Irobe | 355/299 X |

*Primary Examiner*—Fred L. Braun
*Attorney, Agent, or Firm*—Fitzpatrick, Cella, Harper & Scinto

[57] ABSTRACT

A process cartridge detachably mountable to a main assembly of an image forming apparatus includes an image bearing member; processing device actable on the image bearing member; an electroconductive grounding member which is in electric connection with the image bearing member, for grounding the image bearing member to the main assembly when the process cartridge is mounted to the main assembly; and a removing member for removing a material deposited on the image bearing member; the removing member is in contact with a region of the image bearing member contactable to the grounding member.

19 Claims, 6 Drawing Sheets

PROCESS CARTRIDGE HAVING AN ELECTROCONDUCTIVE GROUNDING MEMBER AND AN IMAGE FORMING APPARATUS USING SUCH A PROCESS CARTRIDGE

FIELD OF THE INVENTION AND RELATED ART

The present invention relates to a process cartridge and an image forming apparatus. The image forming apparatus includes, for example, an electrophotographic copying machine, a laser beam printer, an LED printer and a facsimile machine.

Heretofore, an image forming apparatus such as a printer is such that a selective exposure is effected on a uniformly charged image bearing member to form an electrostatic latent image, which is visualized by toner, and the toner image is transferred onto a recording material.

In such an apparatus, a photosensitive drum as the image bearing member comprises a drum base of aluminum material or the like and a photosensitive material applied on the outer peripheral surface thereof. At one longitudinal end thereof, a flange gear is fixed to receive driving force from the main assembly of the image forming apparatus. At the other longitudinal end of the photosensitive drum, a bearing member is provided which comprises an electric contact for electric connection with the drum base by contact or the contact member is contacted to the inside surface of the drum base, or may be contacted to a longitudinal end surface of the drum base.

However, in the prior art example, there is a liability that the photosensitive material is applied on the outer peripheral surface of the drum base, the photosensitive material may be in inadvertently deposited on the inside surface or the end surface of the drum base. The photosensitive material has a high resistance (for example, approx. $10^7$ ohm.cm or larger) or is an electrically insulative, and the electric connection by the contact between the contact member and the inside surface or end surface of the drum base, is not stable.

SUMMARY OF THE INVENTION

Accordingly, it is a principal object of the present invention to provide a process cartridge and an image forming apparatus capable of providing high quality images.

It is another object of the present invention to provide a process cartridge and an image forming apparatus in which the electric grounding of an image bearing member is assured.

It is a further object of the present invention to provide a process cartridge and an image forming apparatus in which the electric contact between the image bearing member and an electroconductive grounding member is assured.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Embodiment 1

Figure 1:
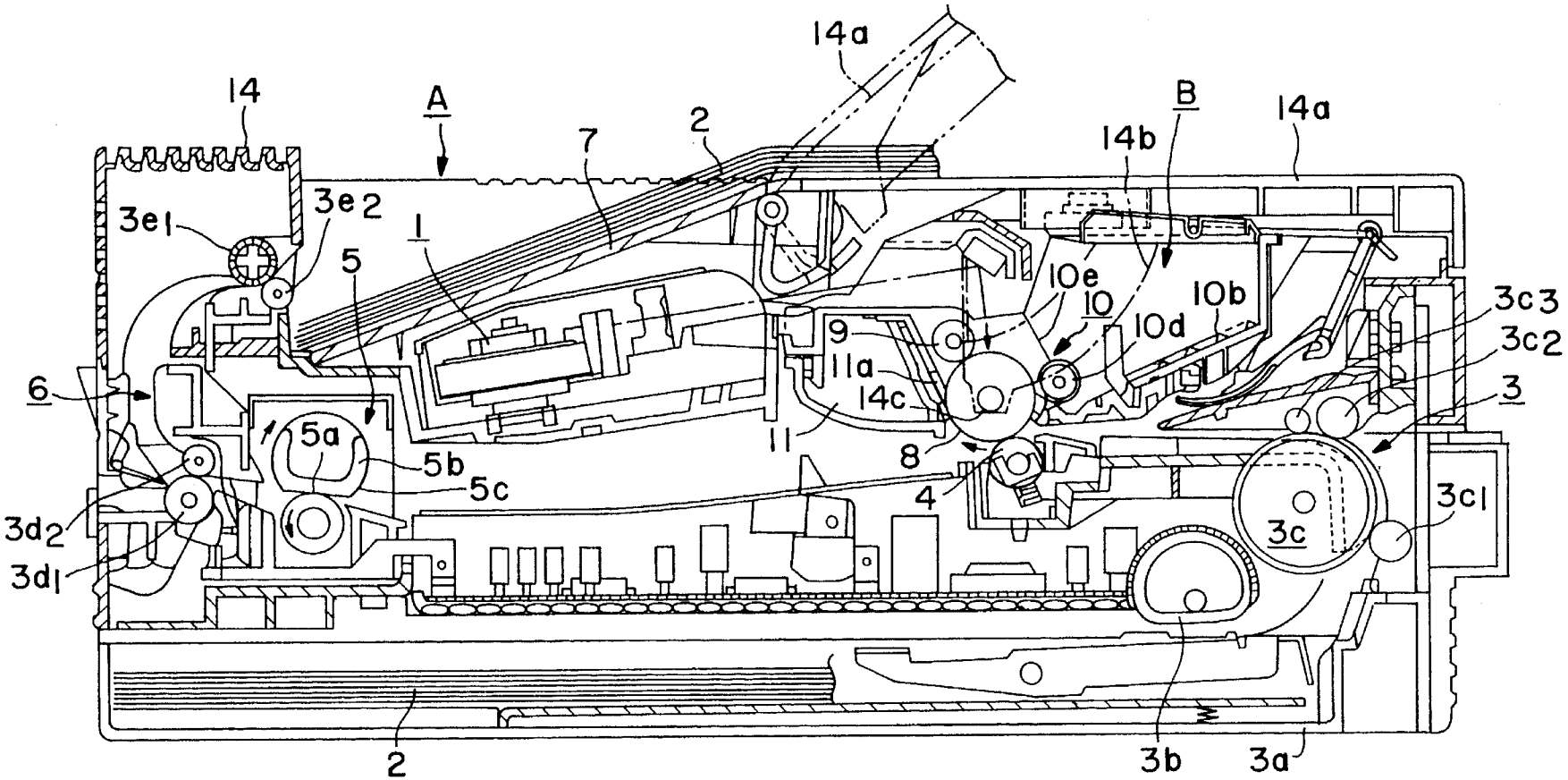
FIG. 1 is a schematic cross-sectional view of an image forming apparatus to which a process cartridge according to an embodiment of the present invention is mounted.
Figure 2:
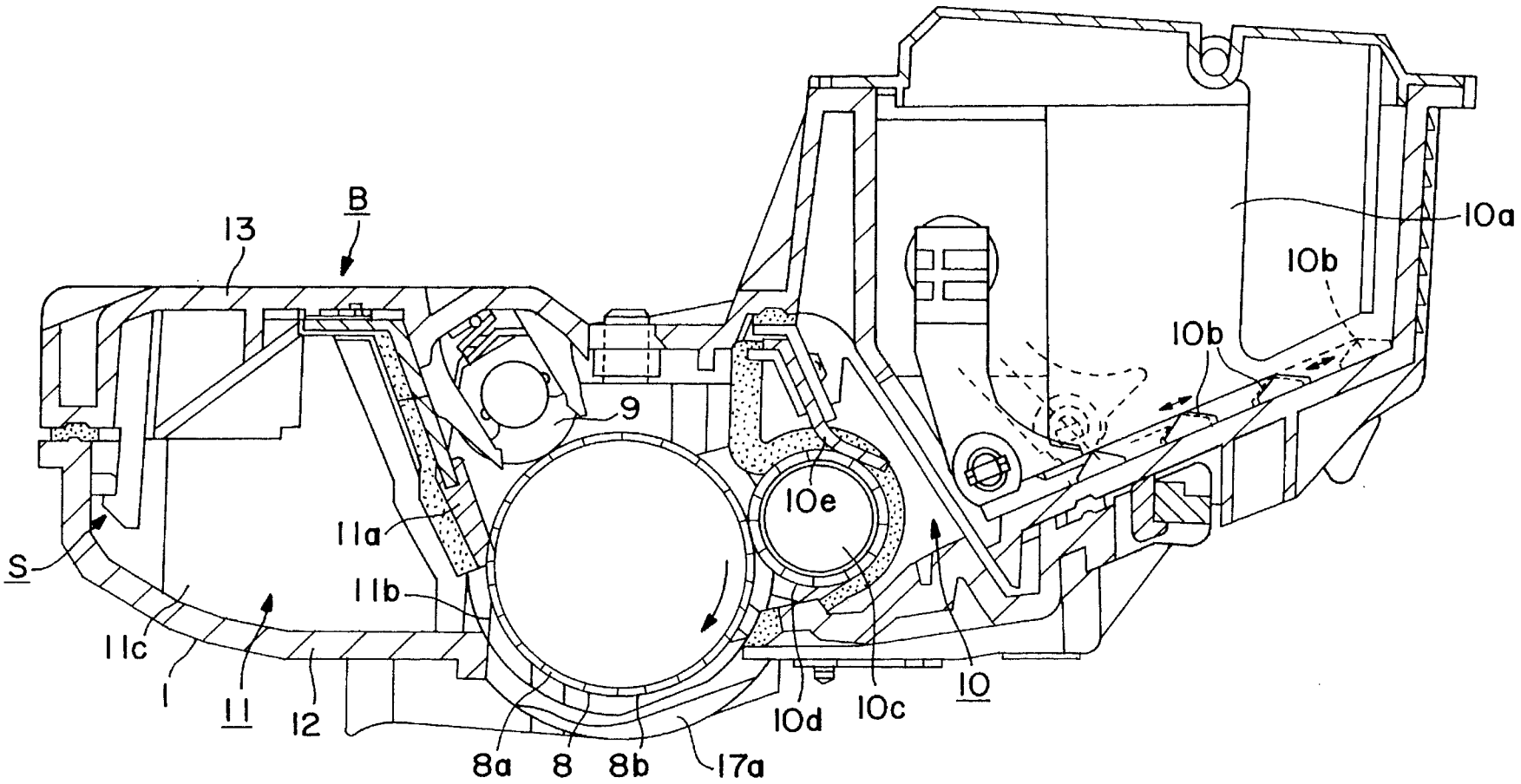
FIG. 2 is a schematic cross-sectional view of a process cartridge according to an embodiment of the present invention.
Figure 3:
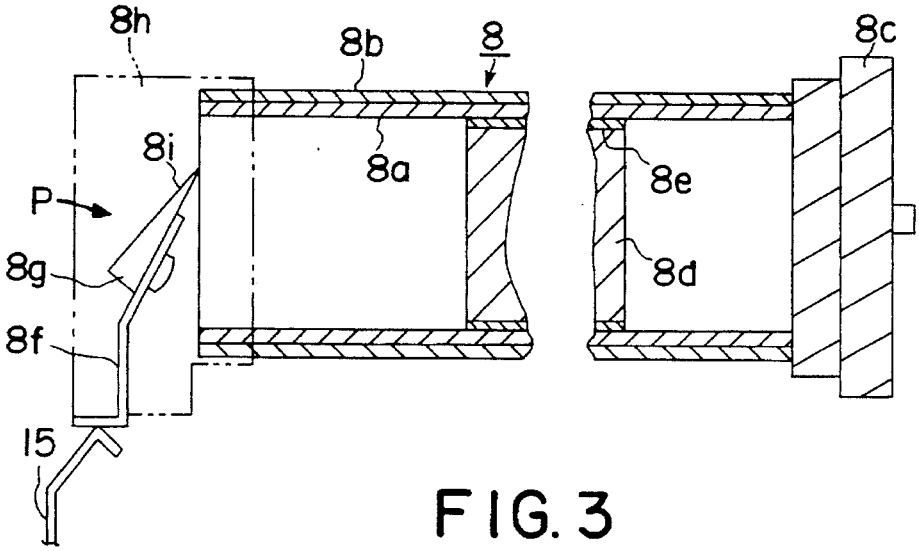
FIG. 3 is a sectional view of a photosensitive drum.

Referring to FIG. 1, the first embodiment of the present invention will be described. FIG. 1 is a sectional view of an image forming apparatus to which a process cartridge according to the first embodiment is detachably mounted, and FIG. 2 is a sectional view of the process cartridge of the first embodiment. FIG. 3 is a sectional view of the photosensitive drum, and FIGS. 4A–6B illustrate contact member (electroconductive grounding member) in sliding contact to an end surface of the photosensitive drum. FIGS. 7A and 7B illustrate a contact member in contact with the inside surface of the photosensitive drum.

General Arrangement:

As shown in FIG. 1, an image forming apparatus A of an electrophotographic type using an electrophotographic image formation process forms a latent image on an electrophotographic photosensitive drum (image bearing member) by projecting light image in accordance with image information through an optical system 1. In synchronism with the formation of the toner image, a recording material 2 is fed by feeding means 3 comprising a pick-up roller 3*b*, a reversing roller 3*c* and pinch rollers 3*c*1, 3*c*2 and 3*c*3 press-contacted thereto and driven thereby. In an image forming station constituted as a process cartridge B, the toner image formed on the photosensitive drum is transferred onto a recording material by application of a voltage to the transfer roller 4 (transfer means) provided in the main assembly. The recording material 2 is fed to an image fixing means 5 comprising a fixing rotatable member 5*b* containing a heater 5*a* and a driving roller 5*c* for press-contacting the recording material 2 to the rotatable member 5*b*, by which the transferred toner image is fixed on the recording material 2. The recording material 2 is fed by discharging roller pairs 3*d*1 and 3*d*2 and discharging roller pairs 3*e*1 and 3*e*2 to discharge to a discharge portion 7 through the reverse feeding passage 6.

On the other hand, the process cartridge B forming the image forming station, as shown in FIG. 2, rotates the photosensitive drum as the image bearing member which will be described hereinafter, and the surface thereof is uniformly charged by application of voltage to a charging roller 9 (charging means). The optical-image from the optical system 1 is projected to the photosensitive drum 8 to form a latent image, which is developed by developing means 10. The developing means 10 feeds the toner in a toner containing portion 10*a* to a developing roller 10*d* by toner feeding member 10*b*. The developing sleeve 10*d* containing therein a stationary magnet 10*c* is rotated, and a layer of the toner triboelectrically charged is formed by a developing plate 10*e* on the surface of the developing sleeve 10*d*. The toner is transferred onto the photosensitive drum 8 in accordance with the latent image, by which the toner image is formed, thus visualizing the latent image. The transfer roller 4 is supplied with a voltage of the polarity opposite from that of the toner is applied to transfer the toner image onto the recording material 2. Thereafter, the residual toner remaining on the photosensitive drum is scraped off the photosensitive drum 8 by an elastic cleaning blade 11*a*. The toner removed by the blade 11*a* is received by a receptor sheet 11*b* to collect the residual toner in a container 11*c*. As described hereinbefore, the residual toner on the photosensitive drum 8 is removed by cleaning means 11 comprising the blade 11*a*, the receptor sheet 11*b* and the residual toner container 11*c*. Various parts such as the photosensitive drum 8, are contained in a cartridge constituted by a top frame 12 and a bottom frame 13. The cartridge is detachably mountable to cartridge mounting means 14*b* and 14*c* of the main assembly 14.

As indicated by a broken line in FIG. 1, in the cartridge mounting means 14*b* and 14*c*, (when the opening member 14*a* is opened), a cartridge mounting guide 14*b* is mounted, as indicated by chain lines with two dots on the left and right inside surfaces of the main assembly 14. Along the guiding member 14*b*, the process cartridge B is inserted, and when the opening member 14*a* is closed, the process cartridge B is mounted to the image forming apparatus A. The positioning of the process cartridge B to the apparatus A is effected by engagement between a projection coaxial with the axis of the photosensitive drum 8 and a recess 14*c* of the guide 14*b*.

Photosensitive Drum:

As shown in FIG. 3, the photosensitive drum 8 of this embodiment comprises a drum base 8*a* of cylindrical aluminum having a thickness of approx. 0.8 mm and an organic photoconductor 8*b* applied on the outer peripheral surface thereof as a photosensitive layer. The photosensitive drum 8 is rotatably mounted to the cartridge frame 12. A driving force from a driving motor (not shown) on the main assembly is transmitted through a flange gear 8*c* fixedly mounted to one longitudinal end of the drum 8, by which the photosensitive drum 8 is rotated in a direction of an arrow in accordance with an image forming operation.

In this embodiment, in order to suppress the vibration of the photosensitive drum, the photosensitive drum 8 contains therein a rigid or elastic filling material 8*d*, as shown in FIG. 3. As the material thereof, aluminum, brass or another metal, cement, plaster or another ceramic material, or natural rubber or another rubber material, are usable. Among them, the material is properly selected in consideration of productivity, machinability, weight effect or manufacturing cost or the like.

The configuration of the filler material 8*d* is columnar or cylindrical. As an example, the filler material 8*d* may have an outer diameter which is smaller than the inside diameter of the photosensitive drum 8 by approx. 100 μm is inserted into a hollow drum base 8*a* and mounted thereto. Thus, the maximum gap between the drum base 8*a* and the filler material 8*d* is not more than 100 μm. A bonding material (cyanoacrylate or epoxy resin material) 8*e* is applied to the internal surface of the drum base 8*a* or the outer surface of the filler material, and the filler material 8*d* is inserted into the drum base 8*a*.

As shown in FIG. 3, in this embodiment, a contact member 8*f* is elastically press-contacted to a longitudinal end surface of the drum base 8*a* of the photosensitive drum 8, to electrically ground the drum 8 through a contact 15 of the main assembly to provide the potential which is the same as the ground potential of the main assembly of the image forming apparatus.

The contact member 8*f* is of stainless steel for a spring, a phosphor bronze for a spring having an electric resistance of not more than approx. $10^3$ ohm.cm, and is mounted to the bearing member 8*a*1.

In this embodiment, the drum base 8*a* has an electroconductivity, that is, the electric resistance thereof is not more than approx. $10^2$ ohm.cm. However, if a material such as the photosensitive material 8*b* or bonding material 8*e* is erroneously deposited on the portion of the surface of the base member 8*a* to be in sliding contact with the contact member 8*f* (not more than approx. $10^3$ ohm.cm in the electric resistance), it is desired that the deposited material which is electrically insulative or which has a high resistance, so as to assure the electric connection. Or, the sliding surface may be oxidized with the result of formation of oxidation film on the sliding surface, with the result of the deterioration to the electric connection.

In this embodiment, a removing member 8*g* is provided to remove the deposited material or the like from the sliding surface of the drum base 8*a*. The removing member 89 comprises plastic material or the like having electric conductivity by dispersing carbon fiber or the like. In this embodiment, the resistivity thereof is not more than $10^4$ ohm.cm approx. The removing member 89 is fixed to an end portion of the contact member 8*f* so that an acute angle portion 8*i* at the end is contacted to the end surface of the drum base 8*a*. In more detail, the acute angle portion 8*i* of the removing member 8*g* is counterdirectionally contacted with respect to the rotational direction of the photosensitive drum 8, and it is elastically urged toward the drum 8 by a pressure P of the contact member 8*f*.

Figure 4A:
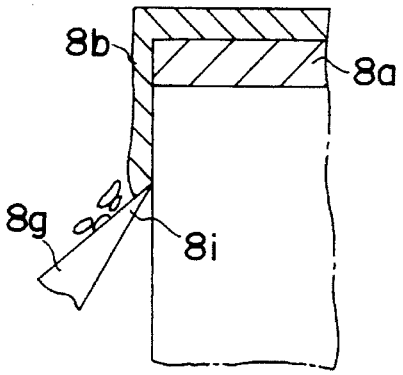
FIGS. 4A and 4B are illustrations of a contact member contacted to an end surface of the drum, according to a first embodiment of the present invention.
Figure 4B:
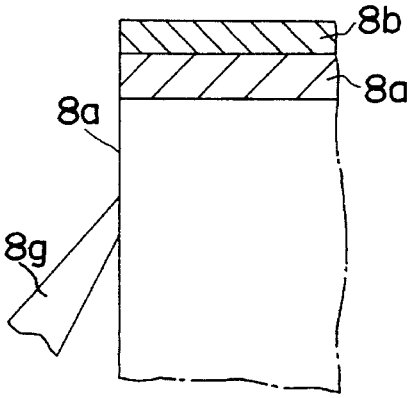

By doing so, as shown in FIGS. 4A and 4B, during initial rotations of the photosensitive drum 8 (approx. 5–6 turns), the removing member 8*g* completely scrapes the deposited material off the sliding surface of the drum 8, and therefore, for normal use (image forming operation), the photosensitive drum 8 is electrically connected with the image bearing member by way of the removing member 8*g*, contact member 8*f* and the contact 15 of the main assembly.

In this embodiment, the removing member 8*g* is formed by electroconductive plastic material, and therefore, only the deposited material on the drum 8 is removed without removing the photosensitive drum 8 itself.

More in detail, the removing member 8*g* is of polyacetal (POM) or polyphenylene sulfite (PPS) or another plastic material in which carbon fiber is dispersed. In order to enhance the removing function, the removing member 8*g* may contain stainless steel (alumina (grinding powder or the like)). In any case, it will suffice if the resistance is not more than $10^4$ ohm.cm, and it can remove the deposited material from the photosensitive drum.

Figure 5A:
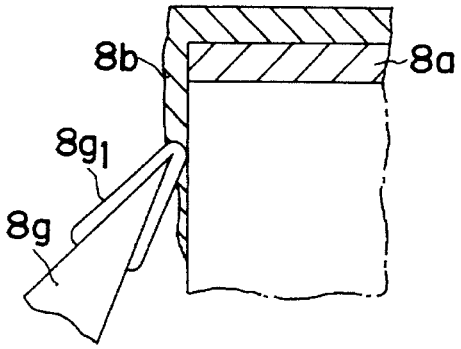
FIG. 5A and 5B are illustrations of a contact member contacted to an end surface of the drum, according to a first embodiment of the present invention.
Figure 5B:
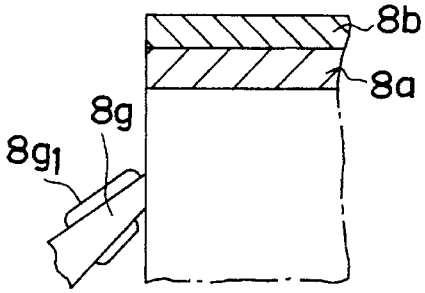

As shown in FIGS. 5A and 5B, the acute angle portion 8*i* of the removing member 8*g*, may contain a coating material

8g1 containing metal powder, alumina grinding powder or the like. By doing so, the deposited material not easily removed can be easily removed. The amount of application of the coating material 8g1 is different if the material of the deposition (photosensitive material 8b or bonding material 8e) is different. However, as shown in FIG. 5B, approx. 3–20 μm is preferable in order that the coating layer (removing function portion) disappears during the initial rotation of the photosensitive drum 8, so that the surface of the conducting function portion of the removing member 8g is exposed and contacted to the drum 8.

Figure 6A:
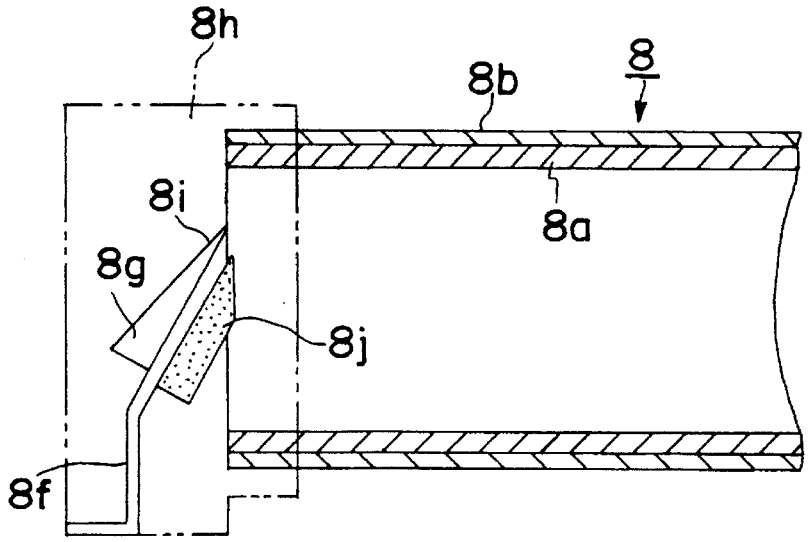
FIGS. 6A and 6B are a cross-sectional view and a perspective view of the contact member according to the first embodiment.
Figure 6B:
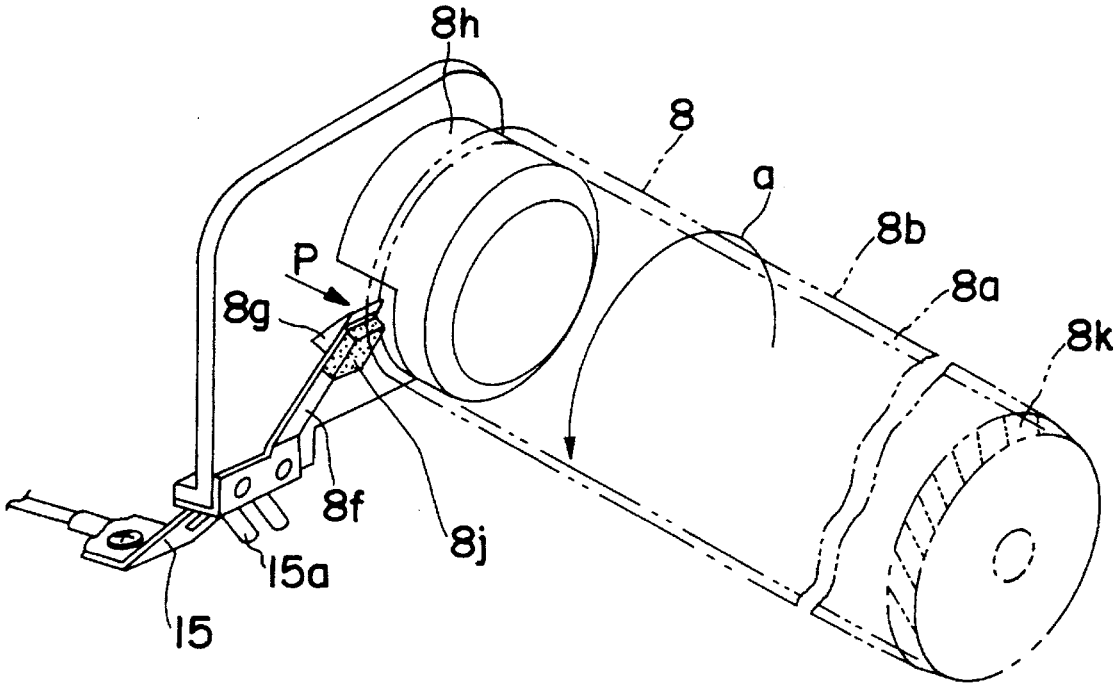
Figure 7A:
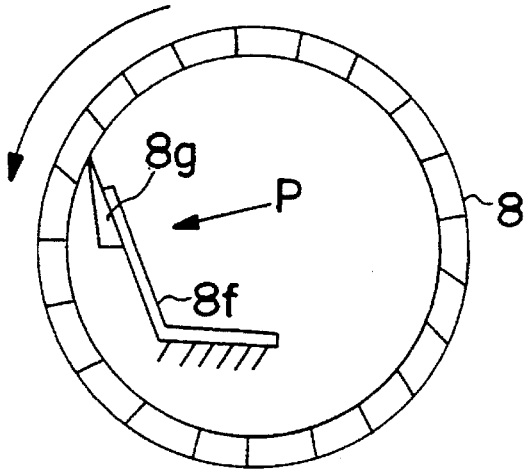
FIGS. 7A and 7B are a cross-sectional view and a perspective view of the contact member contacted to an inside surface of the drum according to the first embodiment.
Figure 7B:
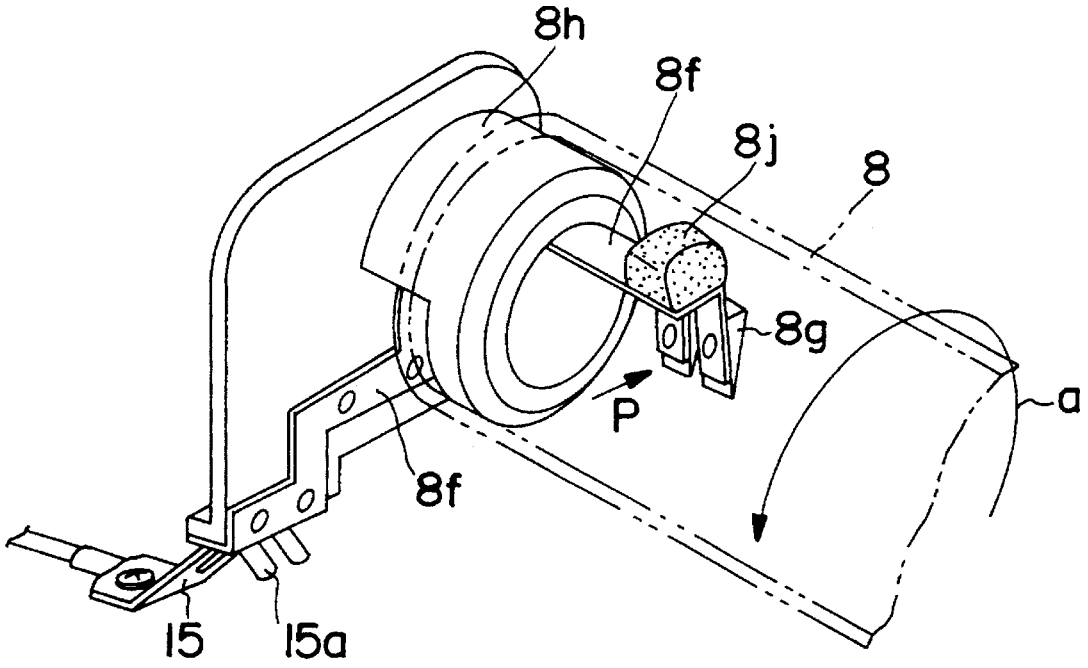

FIGS. 6A and 6B shows another example, and FIGS. 7A and 7B show another example, and the former (6A, 7A) is a sectional view and the latter (6B, 7B) is a perspective view. The photosensitive drum 8 is indicated by phantom lines.

In this embodiment, a cleaning member 8j is provided to remove and collect the removed material, downstream of the removing member 8g with respect to the rotational direction of the dry. The cleaning member 8j is of foamed urethane sheet, wool felt, synthetic fiber material as a major material, and is press-contacted to the sliding surface (removed surface of the removing member 8g) of the photosensitive drum 8. By doing so, the removed material does not contaminate the neighborhood.

As shown in FIG. 5A, the contact member 8f is mounted to the bearing member 8h to press-contact the end surface of the drum base 8a with the removing member 8g. To an end of the contact member 8f, the removing member 8g and the cleaning member 8j are mounted at the upstream portion and the downstream portion, respectively, with respect to the rotational direction of the photosensitive drum 8 (arrow a). The contact member 8f per se has a spring property, and the other end thereof is contacted to a contact 15 of the main assembly. The contact 15 per se has the spring property, so that when the process cartridge B is mounted in the main assembly, the end 15a thereof is elastically brought into contact with the contact member 8f. To the other end of the photosensitive drum 8, a helical gear 8k is fixed, and the helical gear 8k is meshed with a helical gear knot shown) of the main assembly to transmit the driving force.

With the above-described structure, similarly to the foregoing embodiment, the assured contact is established between the contact member 8f and the photosensitive drum 8, more particularly, the drum base 8a, and therefore, the electric connection is stabilized.

Figure 8A:
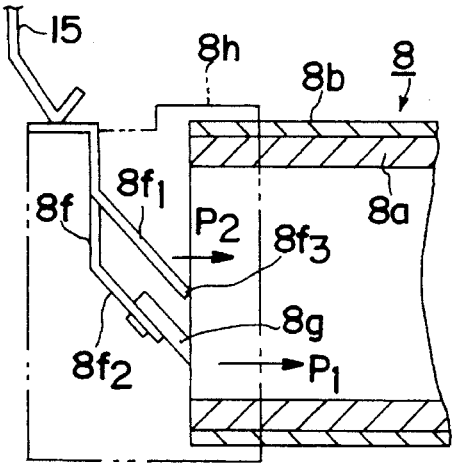
FIGS. 8A and 8B are a sectional view and a perspective view of a contact member contacted to an end surface of the drum according to a second embodiment of the present invention.
Figure 8B:
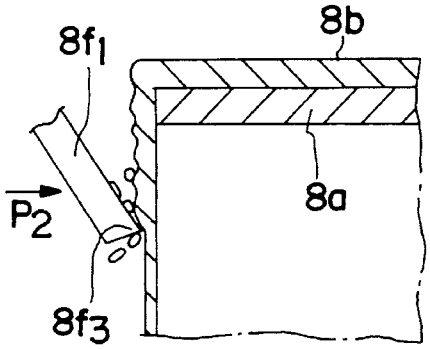
Figure 9:
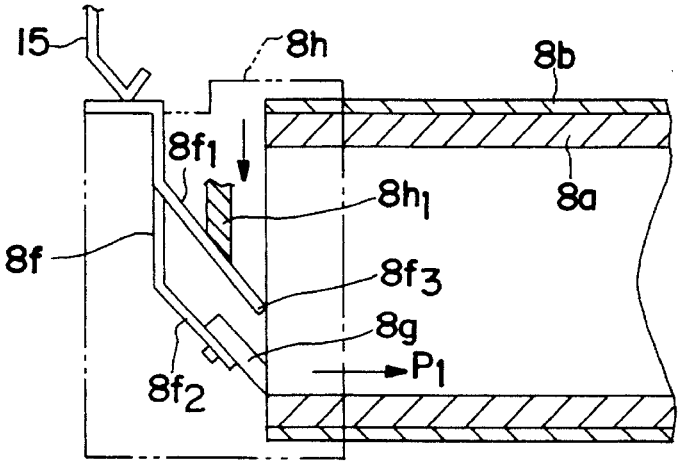
FIG. 9 is an illustration of a contact member contacted to an end surface of the drum, according to the second embodiment of the present invention.

The removing function portion 8f1 of the contact member 8f may be directly contacted to the end surface (FIGS. 8A and 8B). When the possibility exists that the end surface is abraded, electroconductive grease may be applied to the end surface. Or, as shown in FIG. 9, a regulating member 8h1 for regulating the pressing force P2 (FIGS. 8A and 8B) to the drum end surface by the removing function portion 8f1 may be mounted to the bearing member 8h to which the contact member 8f is fixed.

Figure 10:
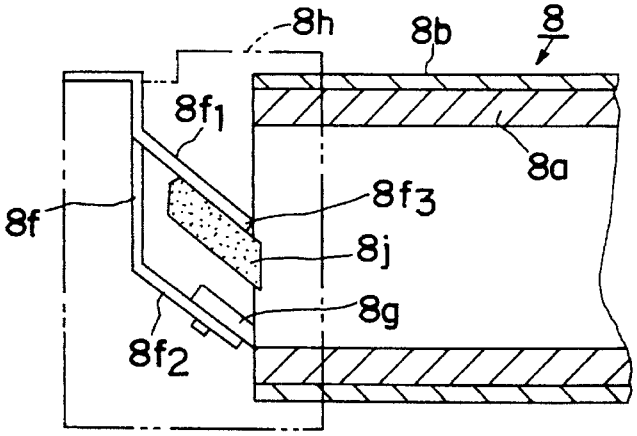
FIG. 10 is an illustration of a contact member contacted to an end surface of the photosensitive drum according to a second embodiment of the present invention.

As shown in FIG. 10, the cleaning member 8j for collecting the removed material may be provided at a downstream portion with respect to the rotational direction of the removing function portion 8f1, as described hereinbefore.

The end portion (edge) of the removing function portion 8f1 may have an abrading material such as grinder fixed thereto. Or, in order to enhance the removing function, the coating material may be applied, as described hereinbefore.

In this embodiment, the contact member 8f is contacted to the end surface of the photosensitive drum 8 (drum base 8a as an example). The present invention is not limited to this, but is applicable to the case in which the contact member is in contact with the inside surface of the photosensitive drum, with the same advantageous effects.

In the foregoing embodiments, the removing member 8g and the removing function portion 8f1 abraded only approx. 50–100 μm the surface of the aluminum drum 8 during approx. 3000 printing operations, and therefore, no problem arises from the abrasion.

Another Embodiment

The process cartridge B according to the present invention is applicable not only to a monochromatic image formation as described hereinbefore but also to a color cartridge having a plurality of developing means to form a multi-color image (two color image, three color image or full color image or the like).

As for the developing method, known two-component magnetic brush development, cascade development, touch-down developing method, cloud developing method or another developing method are usable.

In the first embodiment described above, the charging means is in the form of a so-called contact charging type. A conventional charging means is usable in which comprises a tungsten wire, metal shields of aluminum or the like at three sides thereof, in which a high voltage is applied to the tungsten wire to produce positive or negative ions, which are moved to the surface of the photosensitive drum, thus uniformly charging the surface of the drum.

The contact type charging means may be in the form of a blade (charging blade), pad, block, rod, wire or the like.

As for the cleaning method for removing the toner from the photosensitive drum, a blade, a fur brush, a magnetic brush or the like is usable.

The process cartridge described above comprises an image bearing member in the form of an electrophotographic photosensitive member or the like and at least one process means. Therefore, the process cartridge, in addition to those described above, may contain an image bearing member and charging means; an image bearing member and developing means; an image bearing member and cleaning means; an image bearing member and at least two process means.

In the foregoing embodiment, the photosensitive drum 8 or a developing sleeve 10d are contained in the cartridge, and the process cartridge is mounted to an image forming apparatus to form an image. The present invention is applicable to an image forming apparatus in which the photosensitive drum 8 or the developing sleeve 10d are directly mounted in the main apparatus without use of cartridge structure.

In the foregoing embodiment, the image forming apparatus is in the form of a laser beam printer as an example. However, the present invention is applicable to an electrophotographic copying machine, a facsimile machine, a word processor or another image forming apparatus.

According to the foregoing embodiment, in the initial rotation of the image bearing member approximately inspection rotation in the assembling step or a pre-rotation before start of image forming operation, the deposited material (oxidation coating, photosensitive material, bonding material or the like) is removed from the inside surface or the end surface of the image bearing member, can be removed by the removing member, so that the electric contact between the contact member and the image bearing member is assured, thus stabilizing the electric connection therebetween.

In addition, because an unnecessary deposited material can be removed from the image bearing member by the removing member, therefore, an electrically conductive grounding member and, the image bearing member can be assuredly connected electrically.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus, said process cartridge comprising:

an electrophotographic photosensitive member having an electrophotographic photosensitive layer on the surface of an electroconductive drum base;

process means actable on said electrophotographic photosensitive member;

an electroconductive grounding member which is in electrical contact with said electrophotographic photosensitive member, for grounding said electrophotographic photosensitive member to the main assembly when said process cartridge is mounted to the main assembly;

a removing member for removing material deposited on said electrophotographic photosensitive member, said removing member being in contact with a region of said electrophotographic photosensitive member contactable to said electroconductive grounding member, wherein a pressure between said electroconductive grounding member and said electrophotographic photosensitive member is larger than a pressure between said removing member and said electrophotographic photosensitive member, and wherein said electroconductive grounding member and said removing member are elastically connected to said electrophotographic photosensitive member.

2. A process cartridge according to claim 1, wherein the pressure between said removing member and said electrophotographic photosensitive member is not higher than 50 g, and the pressure between said electroconductive grounding member and said electrophotographic photosensitive member is approximately 50–200 g.

3. A process cartridge according to claim 1, wherein a material of said electroconductive grounding member is stainless steel or phosphor bronze.

4. A process cartridge according to claim 1, wherein a material of said removing member is a plastic material, ceramic material or sintered metal alloy.

5. A process cartridge according to claim 1, further comprising a cleaning member for collecting material removed from said electrophotographic photosensitive member by said removing member.

6. A process cartridge detachably mountable to a main assembly of an image forming apparatus, said process cartridge comprising:

an electrophotographic photosensitive member;

process means actable on said electrophotographic photosensitive member;

an electroconductive grounding member which is in electrical contact with said electrophotographic photosensitive member, for grounding said electrophotographic photosensitive member to the main assembly when said process cartridge is mounted to the main assembly;

a removing member for removing material deposited on said electrophotographic photosensitive member, said removing member being in contact with a region of said electrophotographic photosensitive member contactable to said electroconductive grounding member; and a cleaning member for collecting material removed from said electrophotographic photosensitive member by said removing member.

7. A process cartridge according to claim 6, wherein said electrophotographic photosensitive member includes an electrophotographic photosensitive layer on the surface of an electroconductive drum base, and said electroconductive grounding member and said removing member are elastically contacted to said electrophotographic photosensitive member.

8. A process cartridge detachably mountable to a main assembly of an image forming apparatus, said process cartridge comprising:

an electrophotographic photosensitive member;

process means actable on said electrophotographic photosensitive member;

an electroconductive grounding member which is in electrical contact with said electrophotographic photosensitive member, for grounding said electrophotographic photosensitive member to the main assembly when said process cartridge is mounted to the main assembly; and a removing member for removing material deposited on said electrophotographic photosensitive member, said removing member being in contact with a region of said electrophotographic photosensitive member contactable to said electroconductive grounding member, wherein said removing member is provided at an end of said electroconductive grounding member, and said removing member is worn during initial rotation of said electrophotographic photosensitive member, and thereafter, said electroconductive grounding member is contacted to said electrophotographic photosensitive member.

9. A process cartridge detachably mountable to a main assembly of an electrophotographic image forming apparatus, said process cartridge comprising:

an electrophotographic photosensitive member including an electroconductive base member having an electrophotographic photosensitive layer on a surface thereof;

a process device actable on said electrophotographic photosensitive member;

an electroconductive grounding member elastically pressed to said electroconductive base member to electrically ground said electroconductive base member to the main assembly of the image forming apparatus when said process cartridge is mounted to the main assembly;

a removing member, elastically pressed to a region of said electroconductive base member contactable to said electroconductive grounding member, for removing material deposited on said electrophotographic photosensitive member, wherein, when said process cartridge is mounted to the main assembly, said electroconductive grounding member is electrically contacted to the main assembly to establish electrical grounding of said electroconductive base member to the main assembly, and wherein a pressure between said electroconductive grounding member and said electrophotographic photosensitive member is larger than a pressure between said removing member and said electrophotographic photosensitive member.

10. A process cartridge according to claim 9, wherein the pressure between said removing member and said electrophotographic photosensitive member is not higher than 50 g, and the pressure between said electroconductive grounding member and said electrophotographic photosensitive member is approximately 50–200 g.

11. A process cartridge according to claim 10, further comprising a cleaning member for collecting material removed from said electrophotographic photosensitive member by said removing member.

12. A process cartridge according to claim 11, wherein a material of said cleaning member is a urethane sheet, felt or synthetic fiber material.

13. A process cartridge according to claim 9, wherein a material of said electroconductive grounding member is stainless steel or phosphor bronze.

14. A process cartridge according to claim 9, wherein a material of said removing member is a plastic material, ceramic material or sintered metal alloy.

15. A process cartridge according to claim 9, further comprising a cleaning member for collecting material removed from said electrophotographic photosensitive member by said removing member.

16. A process cartridge according to claim 15, wherein a material of said cleaning member is a urethane sheet, felt or synthetic fiber material.

17. A process cartridge detachably mountable to a main assembly of an electrophotograghic image forming apparatus, said process cartridge comprising:

an electrophotographic photosensitive member including an electroconductive base member having an electrophotographic photosensitive layer on a surface thereof;

a process device actable on said electrophotographic photosensitive member;

an electroconductive grounding member elastically pressed to said electroconductive base member to electrically ground said electroconductive base member to the main assembly of the image forming apparatus when said process cartridge is mounted to the main assembly;

a removing member, elastically pressed to a region of said electroconductive base member contactable to said electroconductive grounding member, for removing material deposited on said electrophotographic photosensitive member, and a cleaning member for collecting material removed from said electrophotographic photosensitive member by said removing member, wherein, when said process cartridge is mounted to the main assembly, said electroconductive grounding member is electrically contacted to the main assembly to establish electrical grounding of said electroconductive base member to the main assembly.

18. A process cartridge according to claim 17, wherein a material of said cleaning member is a urethane sheet, felt or synthetic fiber material.

19. A process cartridge detachably mountable to a main assembly of an electrophotographic image forming apparatus, said process cartridge comprising:

an electrophotographic photosensitive member including an electroconductive base member having an electrophotographic photosensitive layer on a surface thereof;

a process device actable on said electrophotographic photosensitive member;

an electroconductive grounding member elastically pressed to said electroconductive base member to electrically ground said electroconductive base member to the main assembly of the image forming apparatus when said process cartridge is mounted to the main assembly;

a removing member, elastically pressed to a region of said electroconductive base member contactable to said electroconductive grounding member for removing material deposited on said electrophotographic photosensitive member, wherein, when said process cartridge is mounted to the main assembly, said electroconductive grounding member is electrically contacted to the main assembly to establish electrical grounding of said electroconductive base member to the main assembly, and wherein said removing member is provided at an end of said electroconductive grounding member, and said removing member is worn during initial rotation of said electrophotographic photosensitive member, and thereafter, said electroconductive grounding member is contacted to said electrophotographic photosensitive member.

* * * * *

UNITED STATES PATENT AND TRADEMARK OFFICE

CERTIFICATE OF CORRECTION

PATENT NO. : 5,581,325

DATED : December 3, 1996

INVENTOR(S) : TADAYUKI TSUDA, ET AL.

It is certified that error appears in the above-indentified patent and that said Letters Patent is hereby corrected as shown below:

COLUMN 1:

Line 35, "in" should be deleted.

COLUMN 3:

Line 6, "optical-image" should read --optical image--.

COLUMN 4:

Line 34, "89" should read --8g--;
Line 38, "89" should read --8g--; and
Line 67, "8g," should read --8g--.

COLUMN 5:

Line 18, "dry." should read --drum.--;
Line 24, "5A," should read --6A,--; and
Line 38, "knot" should read --(not--.

UNITED STATES PATENT AND TRADEMARK OFFICE

CERTIFICATE OF CORRECTION

PATENT NO. : 5,581,325

DATED : December 3, 1996

INVENTOR(S) : TADAYUKI TSUDA, ET AL.

It is certified that error appears in the above-indentified patent and that said Letters Patent is hereby corrected as shown below:

COLUMN 6:

Line 64, "and," should read --and--.

Signed and Sealed this

Twenty-second Day of April, 1997

Bruce Lehman

*Attest:*

BRUCE LEHMAN

*Commissioner of Patents and Trademarks*

*Attesting Officer*